US006848264B2

(12) United States Patent
Lee et al.

(10) Patent No.: US 6,848,264 B2
(45) Date of Patent: Feb. 1, 2005

(54) APPARATUS AND METHOD FOR CONTROLLING COOL AIR IN REFRIGERATOR

(75) Inventors: In Won Lee, Gwangmyeong-si (KR); Jay Ho Choi, Seoul (KR); Seong Ho Cho, Seoul (KR); Young Sok Nam, Seoul (KR); In Seop Lee, Seoul (KR); Jae Yong Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 179 days.

(21) Appl. No.: 10/252,596

(22) Filed: Sep. 24, 2002

(65) Prior Publication Data

US 2003/0131541 A1 Jul. 17, 2003

(30) Foreign Application Priority Data

Jan. 17, 2002 (KR) ..... 2002-2823
Jan. 28, 2002 (KR) ..... 2002-4884

(51) Int. Cl.[7] ..... F25D 17/00
(52) U.S. Cl. ..... 62/178; 62/186; 62/408
(58) Field of Search ..... 62/178, 179, 180, 62/186, 407, 408, 153

(56) References Cited

U.S. PATENT DOCUMENTS 6,694,758 B1 * 2/2004 Cho et al. ..... 62/179
2003/0140641 A1 * 7/2003 Lee et al. ..... 62/186
2004/0016259 A1 * 1/2004 Cho et al. ..... 62/408
2004/0031276 A1 * 2/2004 Cho et al. ..... 62/186

* cited by examiner

*Primary Examiner*—Marc Norman
(74) *Attorney, Agent, or Firm*—Greenblum & Bernstein, P.L.C.

(57) ABSTRACT

An apparatus controls cool air for directedly cooling a section which is weakly cooled or which stores new loads. The apparatus discharges the cool air by rotating a drive body in accordance with a variation of visual images taken by visual image generator before and after the load is stored. The cool air can also be discharged into a specific storage space by rotating cool air injection nozzles based upon the temperature variation of door baskets detected by temperature sensors. Therefore, a uniform temperature distribution can be maintained in the cooling device to substantially reduce an amount of power consumption.

19 Claims, 9 Drawing Sheets

APPARATUS AND METHOD FOR CONTROLLING COOL AIR IN REFRIGERATOR

BACKGROUND OF THE INVENTION

1. Field of the Invention

The present invention relates to a refrigerator, and more particularly, to an apparatus for controlling cool air in a focused manner to cool a section which is weakly cooled or stores new loads.

2. Description of the Related Art

In general, a refrigerator is used for keeping foods cold or maintaining a uniform temperature in cold storage.

The refrigerator is an apparatus which deprives heat from the surroundings for cooling, through a refrigerating cycle composed of air compressing, air condensing and evaporating steps in order to freeze or refrigerate foods which tend to spoil in warm environments and products such as fish which require freshness.

Due to the convenient feature that the refrigerator can store foods, fish, fruits, drinks and the like as well as freeze the same into edible ices at any time based upon the above principle, the refrigerator has become an essential electric appliance in the modem society.

FIG. 1 is a perspective view illustrating the structure of a typical refrigerator. Referring to FIG. 1, the refrigerator is divided into a freezing chamber 24 and a refrigerating chamber 26 by an interior dividing wall 18 of a housing 14. At least one door (not shown) is mounted to the front of the housing in order to separate the freezing and refrigerating chambers 24 and 26 from the external air.

In the meantime, the refrigerator comprises instruments for the refrigerating cycle which perform the compressing, condensing and evaporating steps to generate cool air necessary for cooling the freezing and refrigerating chambers 24 and 26. Further, the refrigerator is provided at an upper rear section thereof with a blowing chamber 10 which has an air blowing fan 12 for forcibly blowing the cool air generated in the refrigerating cycle into the freezing and refrigerating chambers 24 and 26.

Further, a plurality of cool air forward-discharge ports 20*a* for discharging the cool air forward are formed in certain positions with respect to the compartment dividing wall 18 between the freezing and refrigerating chambers 24 and 26 which mutually communicate with the blowing chamber 10.

Further, a cool air suction port 22 may be provided in a certain position for sucking in the surrounding air.

In the refrigerator illustrated and discussed as above, a compressor compresses a gaseous coolant with low temperature and pressure into a high temperature and pressure state. The compressed gaseous coolant with high temperature and pressure is cooled and condensed into a liquid state with high pressure while passing through a condenser. The liquid coolant with high pressure has its temperature and pressure lowered while passing through a capillary tube (not shown). Then, in an evaporator, the liquid coolant is transformed into a gaseous state with low temperature and pressure while absorbing heat from the surroundings so as to cool the air in the surroundings. In sequence, the air cooled through the evaporator is circulated through the freezing chamber 24 and then the refrigerating chamber 26 due to the operation of the blowing fan 12 so as to lower the internal temperature of the freezing and refrigerating chambers.

As described above, the refrigerator is provided with a cool air distributing system for uniformly distributing the cool air generated around the evaporator to the storage spaces of the freezing and refrigerating chambers. Of course, the cool air distributing system is variously configured according to the kind of the refrigerator.

Describing the cool air distributing system in reference to FIGS. 1 and 2, the refrigerating chamber 26 is provided in the upper end with a damper 20 which communicates with the blowing chamber 10.

At one side of the damper 20 are provided the cool air forward-discharge ports 20*a* for discharging the cool air forwardly and cool air downward-discharge ports 20*b* for discharging the cool air downwardly.

Therefore, in the cool air distributing system configured as above, the cool air generated around the evaporator and transferred into the blowing chamber 10 is distributed to the freezing chamber 24 and the damper 20 with the blowing fan 12 provided in the blowing chamber 10.

In this case, the cool air introduced into the freezing chamber 24 circulates through the inside of the freezing chamber before moving into the evaporator again via the cool air suction port 22 at the bottom of the freezing chamber. Then, the cool air introduced into the damper 20 is discharged into the refrigerating chamber 26 via the cool air forward-discharge ports 20*a* at the side.

The cool air discharged into an upper section of the refrigerating chamber via the cool air forward-discharge ports 20*a* is distributed to storage spaces defined by storage shelves 16 while flowing downward via spaces between a door 15 and the storage shelves 16. Then, the cool air is finally introduced into the cool air suction port 22 connected to the evaporator.

However, according to the related art as set forth above, the cool air discharged from the upper damper is not properly transferred into middle and lower sections of the refrigerating chamber far from the damper so that a refrigerating operation is not effectively carried out thereby resulting in a problem that the refrigerating chamber has a non-uniform temperature distribution.

Since the cool air is not sufficiently transferred around the door 14 is spaced from the upper damper, foods stored in a door basket are not properly cooled as a problem.

In the meantime, the conventional refrigerator configured as above discharges or blocks the cool air into/from the refrigerating chamber 26 by detecting the weight of the shelves 16 in the refrigerating chamber 26 when a new cooling load (e.g. warm food) is introduced or by detecting the weight of the refrigerating chamber 26 itself. Alternatively, the refrigerator discharges or blocks the cool air into/from the entire refrigerating chamber 26 according to its temperature fluctuation by detecting and judging the temperature of the refrigerating chamber 26 itself with a temperature sensor (not shown) mounted on a specific region of the refrigerating chamber 26.

However, according to this cool air controlling method, when the surrounding temperature and weight of the refrigerating chamber are elevated due to the new cooling load as above, the cool air is discharged into the entire refrigerating chamber for a certain time period to lower the elevated surrounding temperature of the entire refrigerator thereby disadvantageously enlarging the amount of power consumption of the refrigerator.

Further, the controlling method of cooling the entire refrigerating chamber as above by cooling the newly stored load while at the same time lowering the temperature of the entire refrigerating chamber, has the disadvantage of decreasing the cooling speed of the new load and the cooling ability of the refrigerator and by requiring a large amount of cooling air.

SUMMARY OF THE INVENTION

Accordingly, the present invention provides a solution to the above problems of the related art. The present invention provides an apparatus for controlling cool air in a refrigerator and an apparatus for concentrically cooling a section in which a new cooling load is stored.

According to an aspect of the invention, an apparatus for controlling cool air in a refrigerator includes at least one visual image generating device that forms an image or photographs a load to generate visual images when an opening/closing operation of a refrigerator door is performed. A controller controls a drive body to rotate according to a correlation between a first visual image taken before the new load is stored and a second visual image taken after the new load is stored, and at least one discharge device that discharges the cool air toward the load according to the control by the control device.

Preferably, the apparatus for controlling cool air further includes a detection device that detects the opening/closing operation of the refrigerator door to transfer a detection signal to the controller.

Preferably, in the apparatus for controlling cool air, the correlation is provided by a variation of position and size of the space for storing the new load.

Preferably, in the apparatus for controlling cool air, the visual image generating device photographs the space for storing the load whenever the refrigerator door is closed.

Preferably, in the apparatus for controlling cool air, the drive body has a spherical shape, and the discharge device is inserted through the drive body, and the drive body is mounted on an inside wall of the refrigerator and inserted into a drive body housing having a spherical inner shape.

Preferably, in the apparatus for controlling cool air, a rotational degree of the drive body varies according to the position and size of the space for storing the load.

Also in the apparatus for controlling cool air, it is preferred that the visual image generating device is positioned above each of the drive bodies.

According to another aspect of the invention, a method for controlling cool air in a refrigerator is provided. The method includes photographing a load to generate visual images whenever an opening/closing operation of a refrigerator door is performed, controlling a drive body to rotate according to a correlation between a first visual image taken before the load is stored and a second visual image taken after the load is stored, and discharging the cool air toward the load.

Preferably, in the method for controlling cool air, the visual image is generated whenever an opening/closing operation of the refrigerator door is detected.

Preferably, in the method for controlling cool air, a rotational degree of the drive body varies according to the position and size of the space for storing the load.

According to further another aspect of the invention, a method for controlling cool air in a refrigerator is provided. The method includes transferring a photographing command into visual image generating device by a control device according to an opening/closing operation of a refrigerator door, transferring, by the visual image generating device, a visual image generated by photographing a space for storing a load to the control device in response to the photographing command, and controlling by the control device, a drive body to rotate the drive body according to variation of the visual image to discharge the cool air.

Preferably, in the method for controlling cool air, the control device generates the photographing command based upon a detection signal detected according to the opening/closing operation of the refrigerator door.

Preferably, in the method for controlling cool air, the variation of the visual image can be determined according to existence of the load in the space for storing the load.

According to still another aspect of the invention, an apparatus is provided for controlling cool air in a refrigerator including an auxiliary duct provided in a compartment between a freezing chamber and a refrigerating chamber, the auxiliary duct being connected to one side of a damper communicating with a blowing chamber. A plurality of cool air injection nozzles are provided in the auxiliary duct at intervals for injecting the cool air, and a plurality of temperature sensors are respectively provided in one side of each door baskets for detecting the temperatures thereof. A controller controls drive motors to rotate the cool air injection nozzles according to a temperature variation of storage spaces of the door baskets detected by the temperature sensors.

Preferably, the apparatus for controlling cool air further includes an auxiliary blowing fan at one side of the damper for compressing the cool air toward the auxiliary duct.

Preferably, in the apparatus for controlling cool air, a rotational degree of each cool air injection nozzle varies according to a position of a storage space having a temperature variation.

DETAILED DESCRIPTION OF THE PREFERRED EMBODIMENT

The following detailed description presents preferred embodiments of the invention in reference to the accompanying drawings.

Figure 1:
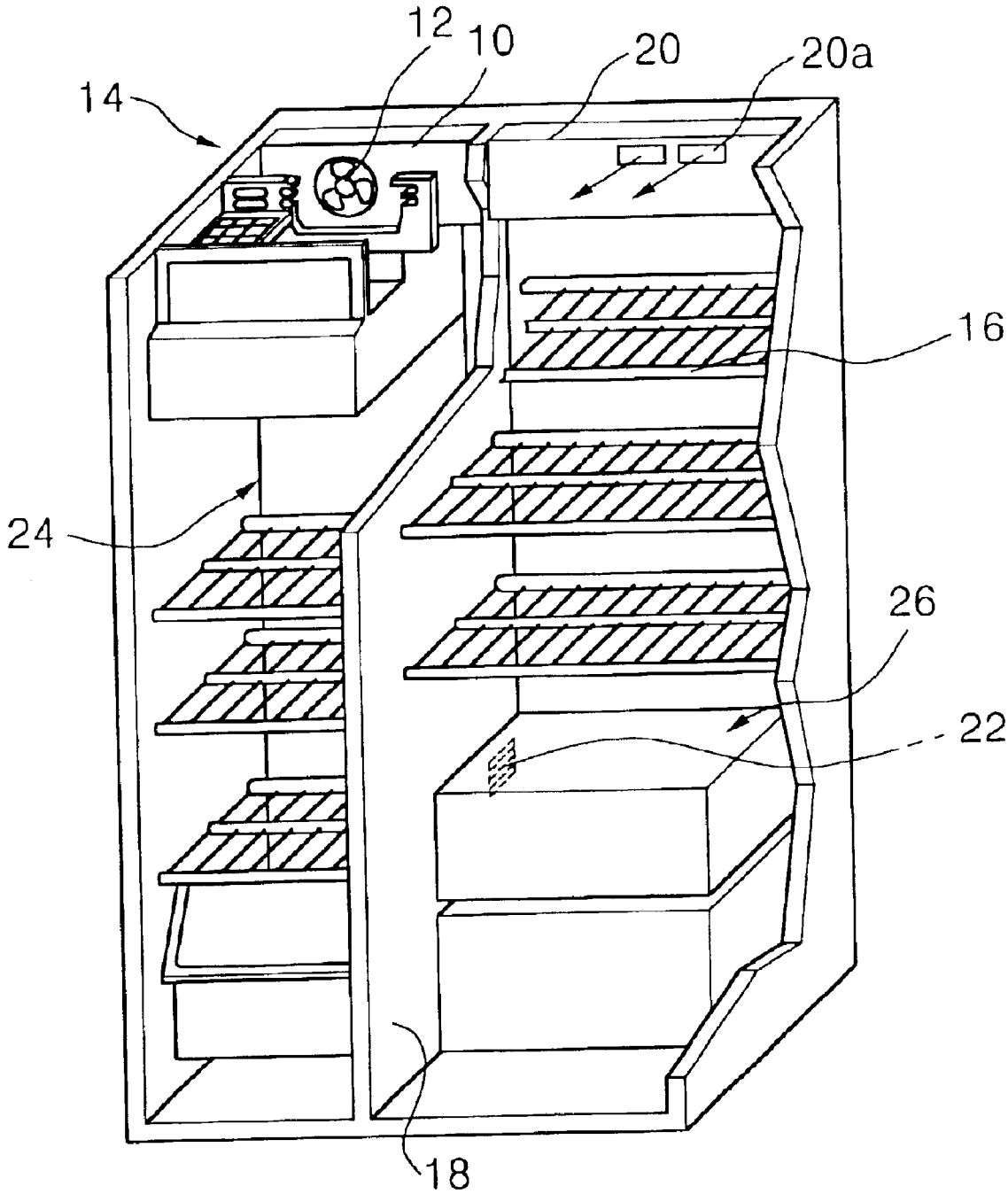
Fig. 1(Related Art)
FIG. 1 is a perspective view illustrating the structure of a general refrigerator.
Figure 2:
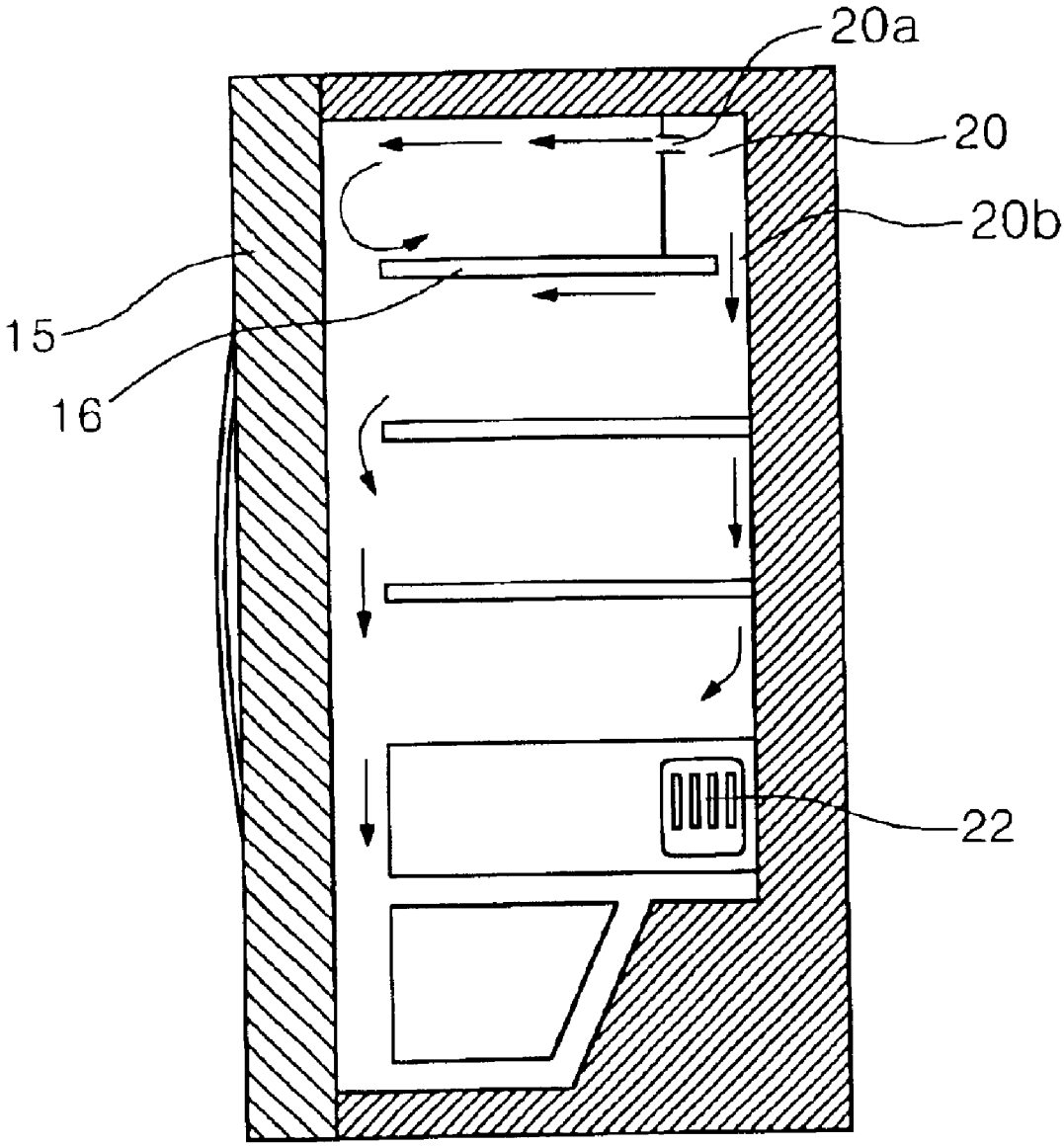
Fig. 2(Related Art)
FIG. 2 is a schematic sectional view illustrating cool air circulation according to a conventional cool air distributing system.
Figure 3:
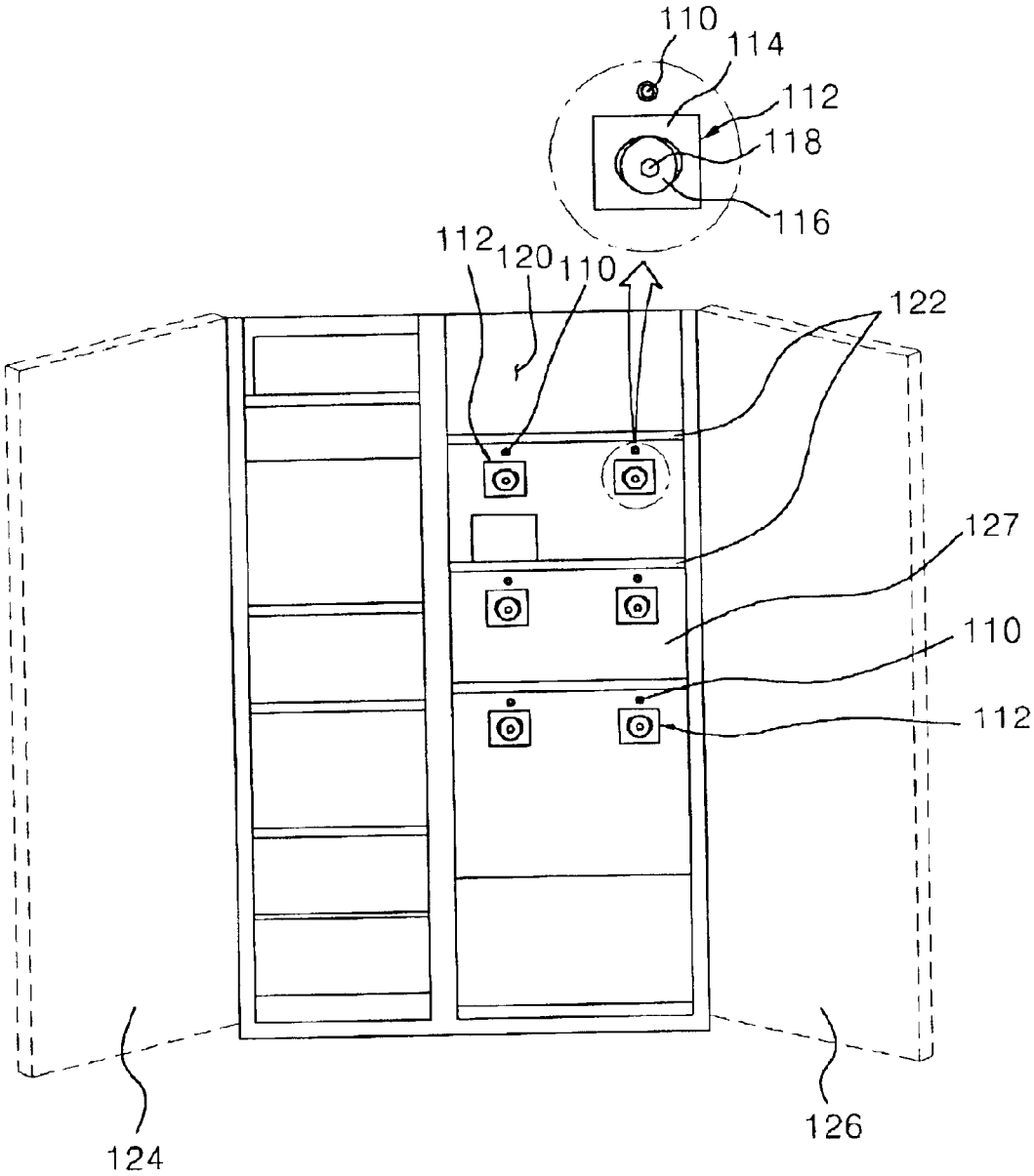
FIG. 3 is a schematic view illustrating a refrigerator according to a preferred embodiment of the invention.
Figure 4:
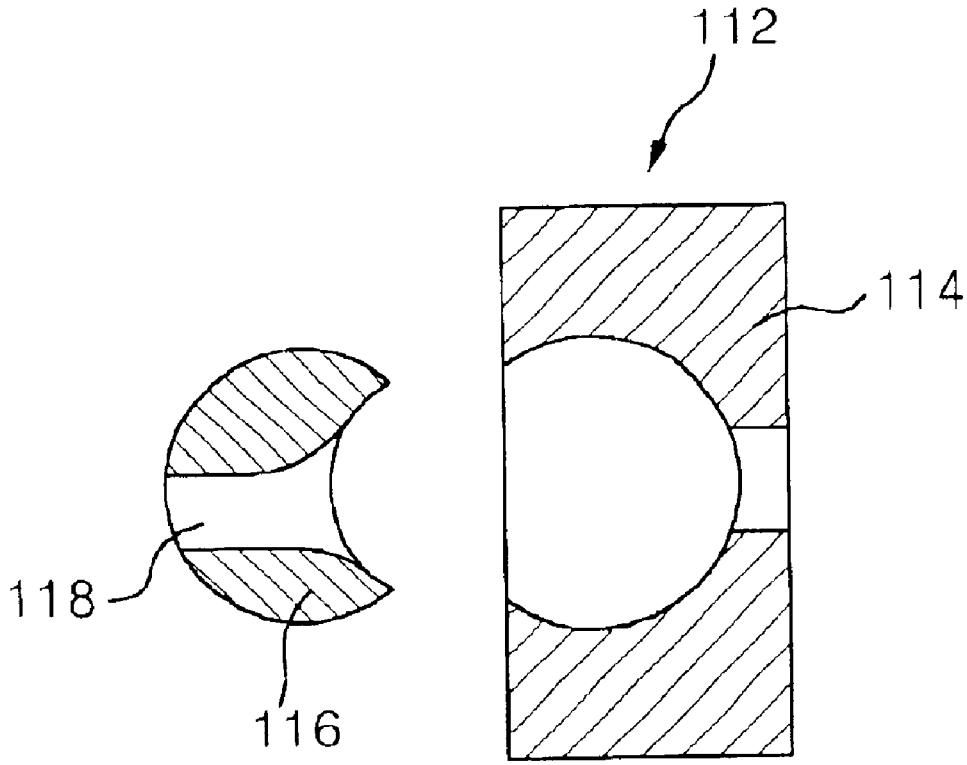
FIG. 4 is a sectional view illustrating a rotary member having a cool air discharge port shown in FIG. 3.

FIG. 3 is a schematic view illustrating a refrigerator according to a preferred embodiment of the invention, and FIG. 4 is a sectional view illustrating a rotary member having a cool air discharge port shown in FIG. 3.

Referring to FIGS. 3 and 4, the refrigerator is provided with a plurality of image devices 110 on inside wall 127 in storage spaces defined by shelves 122. Preferably, the image devices 110 are digital cameras capable of photographing objects. The objects are photographed by the image devices 110 so that image data of the objects can be input into a controller (not shown) provided in the refrigerator. In this case, the controller is preferably a microprocessor for optimizing the operation of refrigerator using signals input from various sensors and electronic devices of the refrigerator.

Further, two image devices 110 are mounted on the inside wall 127, respectively, in each of the storage spaces defined by the shelves 122. Of course more or fewer imaging devices can be provided within the scope of the present invention.

At a predetermined distance under each of the image devices 110, the refrigerator is provided with a rotary member 112 corresponding to the image device 110. The rotary member 112 is mounted under the image device 110 on the inside wall 127 of the refrigerating chamber 120. The rotary member 112 is provided with a drive body housing 114 having a circular inner shape so as to store a spherically-shaped drive body 116 which is rotates therein. In this case, the drive body 116 is inserted into the drive body housing 114 to be rotated therein under the control of the controller. Of course, in its essential aspect the present invention does not require an exact correspondence between the numbers of imaging devices 110 and rotary members 112.

The rotary member 112 may be provided with a cool air discharge port 118 (or a plurality thereof) which can discharge cool air to a new load (e.g. food) when the new load is stored in the refrigerating chamber 120.

Therefore, when the new load is stored in the refrigerating chamber 120, the cool air is discharged toward the new load by rotating the drive body toward the new load based upon the correlation between images taken by each of the image devices 110 before and after the new load is stored.

Herein the reference numbers 124 and 126, respectively, indicate doors for opening the freezing chamber and the refrigerating chamber.

The following description presents a method for controlling cool air with each image device mounted on the inside wall in a specific storage space of the refrigerating chamber of the refrigerator.

Figure 5A:
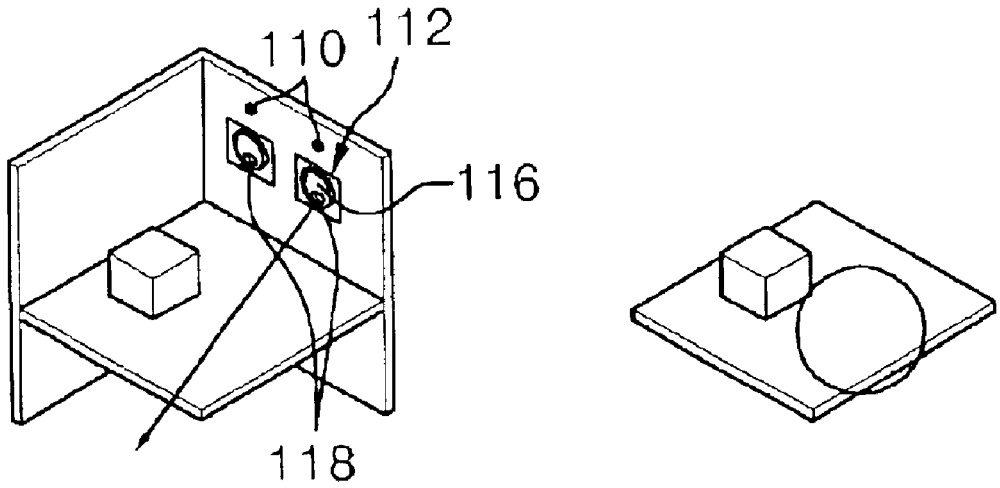
FIGS. 5A to 5C are perspective views illustrating cool air discharged toward a load stored in the refrigerator according to the preferred embodiment of the invention.
Figure 5B:
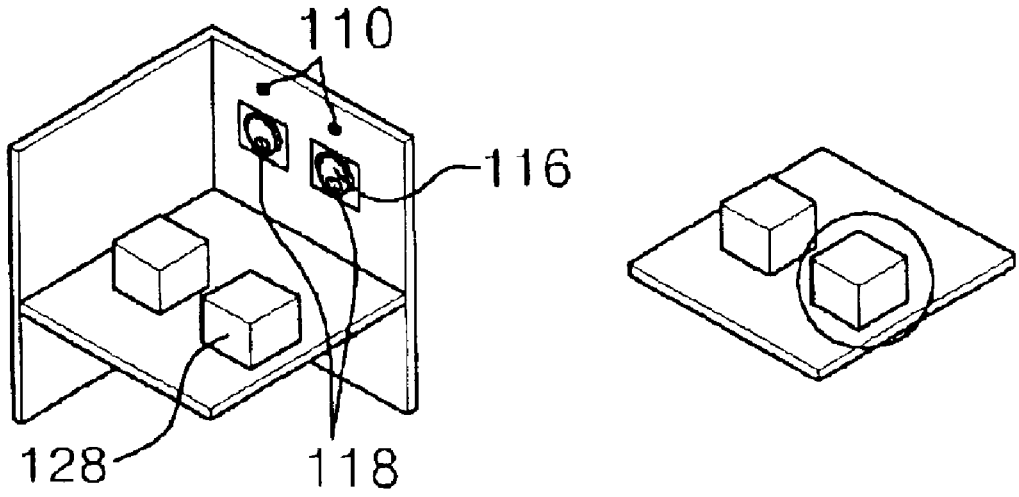
Figure 5C:
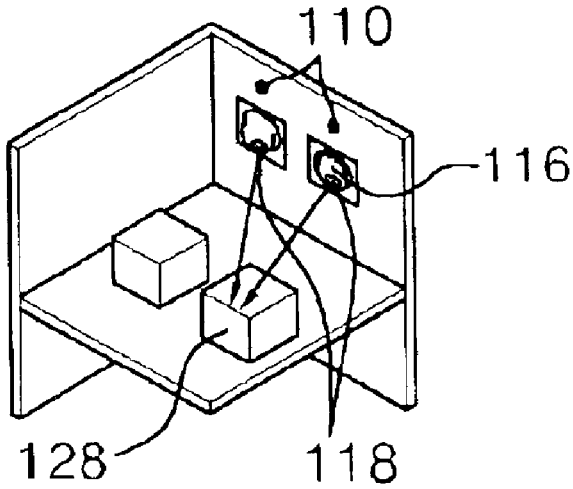

FIGS. 5A to 5C are perspective views illustrating the cool air discharged toward the load stored in the refrigerator according to the preferred embodiment of the invention.

First, the image device 110 photographs a storage space for storing the load 128 to generate a visual image before the load (food) is stored in the refrigerating chamber. The image device is activated to take visual images according to opening/closing of the refrigerator. For example, when a user opens/closes the refrigerator before the load is stored, the image device is activated due to opening/closing of the refrigerator to photograph the space for storing the load. In this case, the visual image previously taken by the image device is input into the controller (FIG. 5A). As can be seen in FIG. 5A (right portion) the image shows.

When the user opens/closes the refrigerator again to store the load in the refrigerator, the image device 110 photographs the space for storing the load again. In other words, the user opens the door of the refrigerator, positions the load in the space of the refrigerator for storing the load, and then closes the door again. Then, closing of the refrigerator door activates the image device to photograph the specific space for storing the load. The visual image photographed as above is input into the controller (FIG. 5B).

The controller compares the visual images before and after the load is stored in order to judge the position and size of the load. Upon judging the position and size of the load, the controller rotates the drive body 116 of the rotary member 112 toward the load to discharge the cool air through the cool air discharge port 118 (FIG. 5C) toward the newly installed load. Of course, in this case, a motor (not shown) is preferably provided between the controller and the drive body 116 in order to rotate the drive body 116. Of course another actuating mechanism such as e.g. an electromagnetic actuator can be used instead of a motor. When the controller operates the motor, the motor rotates the drive body toward the load so that the cool air can be discharged through the cool air discharge port 118.

The method for controlling cool air by using the image devices as set forth above will be described in detail in reference to FIG. 6.

Figure 6:
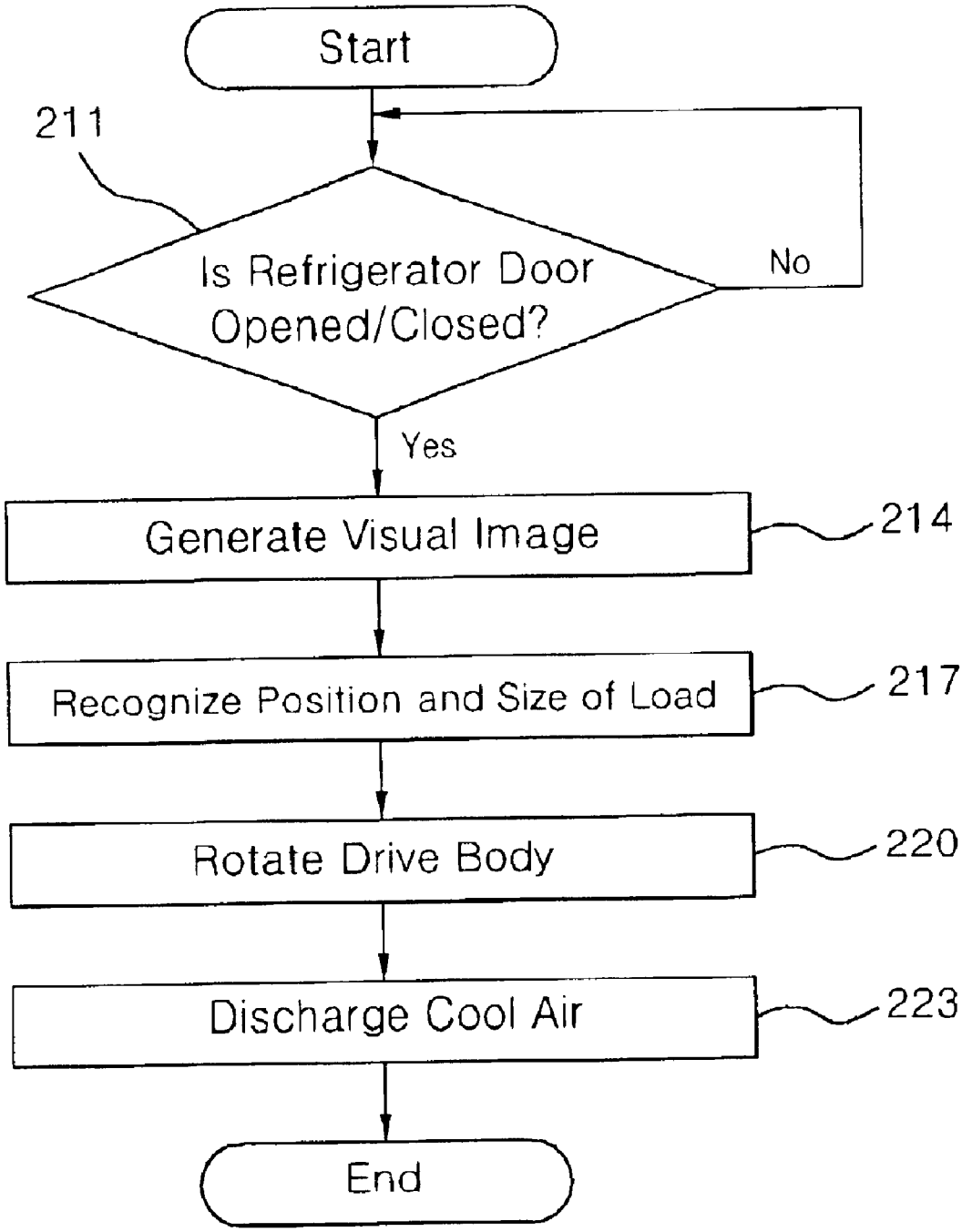
FIG. 6 is a flow chart for illustrating a process of controlling cool air in the refrigerator according to the preferred embodiment of the invention.

FIG. 6 is a flow chart that illustrates a process of controlling cool air in the refrigerator according to the preferred embodiment of the invention.

Referring to FIG. 6, it is first confirmed whether a user opens/closes the door of the refrigerator (S 211). Preferably, a detecting sensor is provided at one side of the door of the refrigerator in order to detect opening/closing of the refrigerator door. Therefore, detection signals generated due to opening/closing of the refrigerator are input into the controller, which can confirm whether the refrigerator is opened or closed based upon the number of the input detection signals. In other words, if one input signal is input from the sensor, the controller determines that the refrigerator is opened. If two input signals are input, the controller determines that the refrigerator is closed.

The controller controls the image devices to photograph the spaces for storing the load based upon opening/closing of the refrigerator. In other words, upon storing the two detection signals from the detecting sensor, the controller judges that the refrigerator is closed and transmits a photographing command to the image devices. Then, the image devices photograph the spaces for storing the load to generate visual images in response to the photographing command (S 214). In this case, each of the visual images is a three-dimensional image displaying the position and size of an object to be photographed (e.g. load) into the shape of a pixel.

If the refrigerator is opened/closed without storing the load, the generated visual images show only the bottoms of the spaces (i.e. tops of the shelves) for storing the load. On the contrary, if the refrigerator is opened/closed with storage of the load, visual images including the load are generated.

Therefore, as the refrigerator is arbitrarily opened/closed, the visual image before storing of the load that have been previously generated are input into the controller. As the refrigerator is opened/closed to store the load, the visual images after storage of the load are generated and input into the controller.

The controller compares the visual images before and after a load is stored to judge the position and size of the load (S 217). In other words, the controller recognizes information about the distance of the load from the reference position and the size thereof using the visual image after the load is stored based upon a comparison with the image before the load is stored.

Upon recognizing the position and size of the load, the controller controls each of the driving bodies to rotate according to the position and size of the load by operating each of the motors (S 220).

When each drive body is adjusted corresponding to the size and position of the load, cool air is discharged through the cool air discharge port arranged in a central portion of the each drive body under the control of the controller (S 223).

According to the method for controlling cool air using the temperature sensor and the weight of the object according to the preferred embodiment of the invention as set forth above, the newly stored load can be cooled in a more targeted fashion. In other words the cooling air can be directly aimed at the newly installed load.

In the preferred embodiment of the invention as set forth above, a method is described for discharging the cool air toward the load when the load is stored in the refrigerating chamber.

Hereinafter a method for controlling cool air in door baskets which are weakly cooled and frequently store loads is described.

Figure 7:
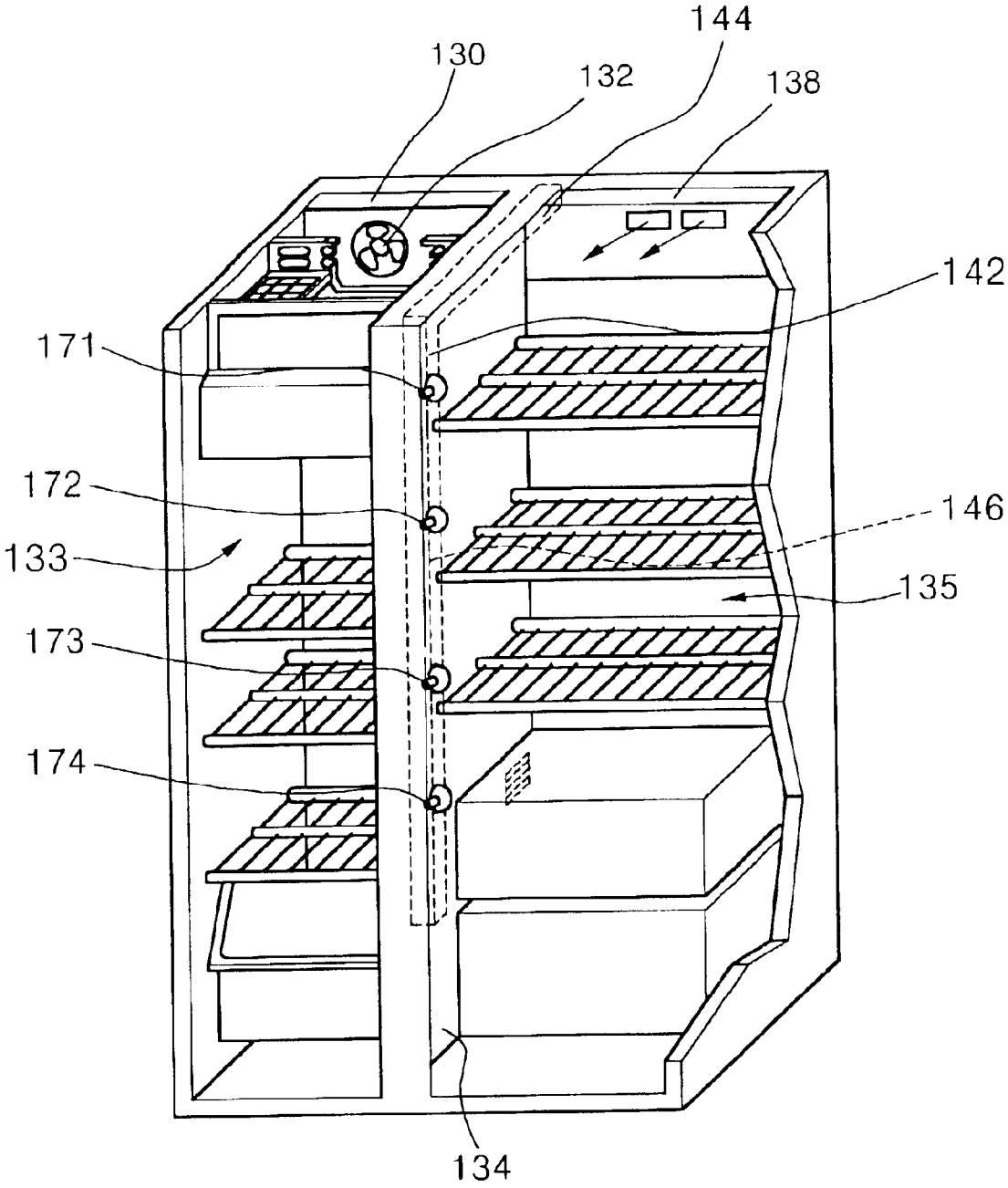
FIG. 7 is a partially sectional perspective view illustrating a refrigerator according to another preferred embodiment of the invention.
Figure 8A:
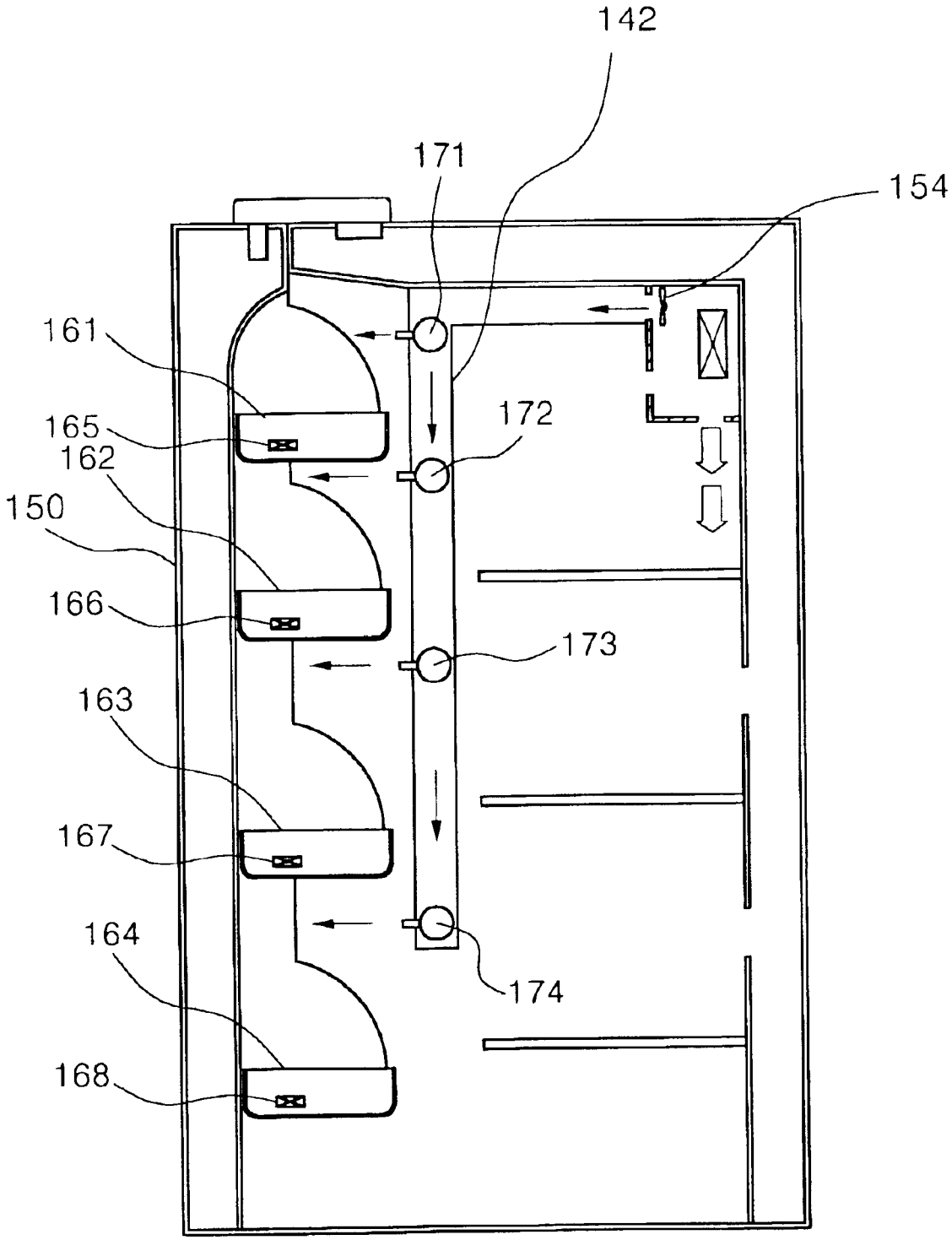
FIGS. 8A and 8B are schematic sectional views illustrating an operation state of discharging cool air toward door baskets in the refrigerator according to the another preferred embodiment of the invention.
Figure 8B:
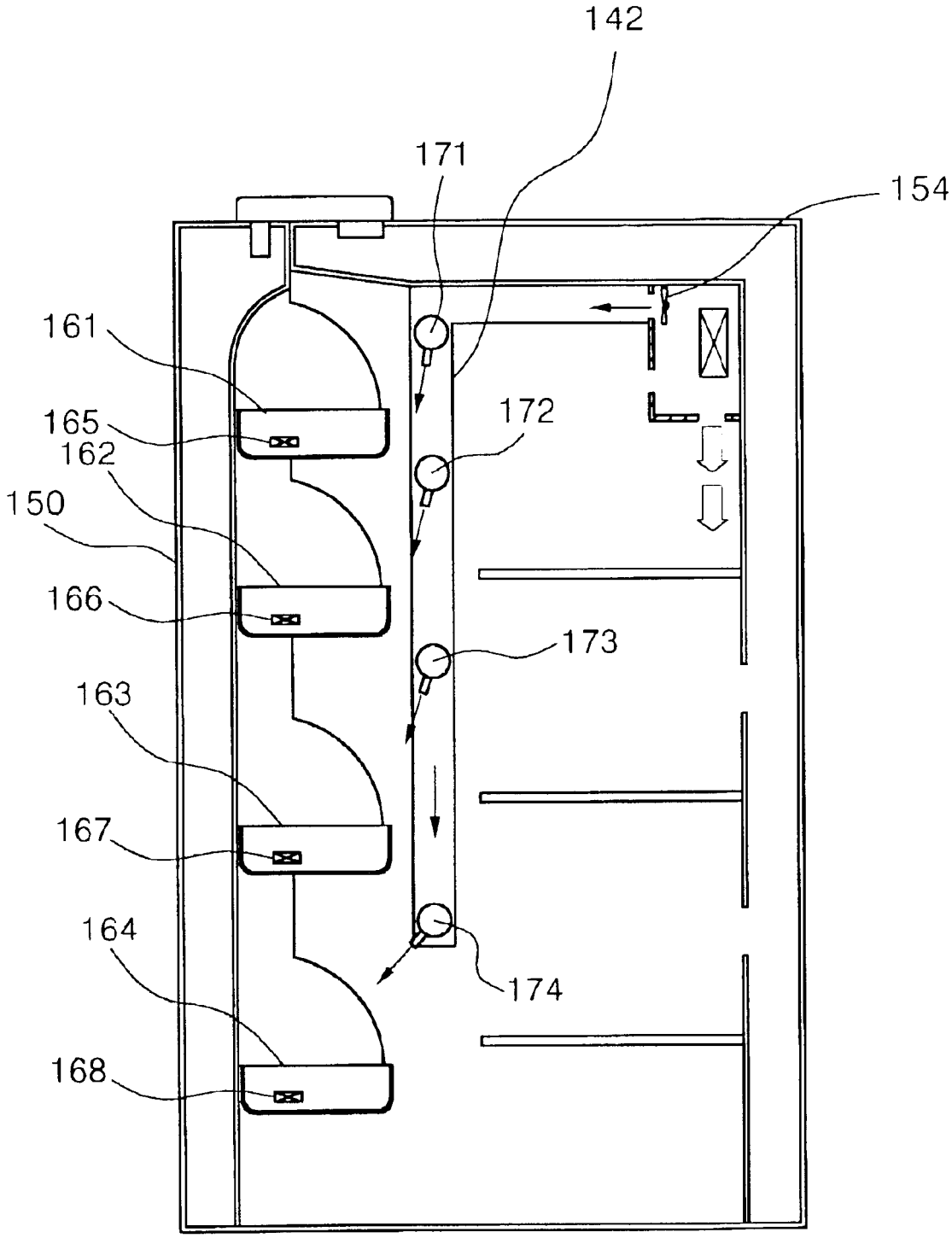

FIG. 7 is a partially sectional perspective view illustrating a refrigerator according to another preferred embodiment of the invention, and FIGS. 8A and 8B are schematic sectional views illustrating an operating state of discharging cool air toward door baskets in the refrigerator according to the another preferred embodiment of the invention.

Referring to FIGS. 7 and 8A, the refrigerator is provided with a blowing chamber 130 and a damper 138 communicating with the blowing chamber 130. At an entrance of the refrigerator through which the cool air is introduced into the damper 138, is further provided a blowing fan 132 is further provided for blowing the cool air toward the damper 138.

Further, the refrigerator is provided with an auxiliary duct 142 through the inside of a compartment wall 134 between a freezing chamber 133 and a refrigerating chamber 135. The auxiliary duct 142 is provided with a plurality of cool air injection nozzles 171 to 174 capable of both rotating within a certain range and injecting the cool air. In this case, it is apparent that the cool air injection nozzles 171 to 174 can be rotated by drive motors or other conventional electromagnetic or other actuators (not shown), which may be respectively connected to the cool air nozzles 171 to 174.

Further, the refrigerating chamber 135 is provided with temperature sensors 165 to 168 respectively arranged in storage spaces defined by door baskets 161 and 164 for detecting temperature. Each of the temperature sensors 165 to 167 sends the temperature detected from each of the storage spaces to a controller, which controls discharge of the cool air according to the temperature detected as above.

The auxiliary duct 142 is divided into a horizontal section 144 extended in parallel toward a door 150 (FIG. 8A) for a certain distance from the damper 138 and a vertical section 146 which extend vertically downward from the leading (i.e. front most) end of the horizontal section.

The cool air injection nozzles 171 to 174 are arranged in the vertical section 146 of the auxiliary duct 142 for a certain distance and at predetermined intervals (uniform or not uniform), and basically extend toward the storage spaces of the door baskets 161 to 164. Preferably, the cool air injection nozzles 171 to 174 are provided corresponding to the storage spaces. If there are four storage spaces, four cool air injection nozzles are provided corresponding thereto. Of course more or fewer cooling nozzles can be provided.

The damper 138 is provided with an auxiliary blowing fan 154 for compressing and ejecting the cool air toward the auxiliary duct 142.

Further, the controller is connected to the drive motors to control the same according the cooling load variation of each of the storage spaces recognized via the temperature sensors 165 to 168, i.e. based upon temperature variation.

The following description discloses a method for controlling cool air in the refrigerator according to the another preferred embodiment of the invention as set forth above.

As shown in FIGS. 7 and 8A, the cool air introduced from the blowing chamber 130 into the damper 138 flows as divided into the auxiliary duct 142 and the damper 138 so that the cool air injection nozzles 171 to 174 of the auxiliary duct 142 continuously inject the cool air. The cool air introduced into the auxiliary duct 142 is injected according to opening/closing of the cool air injection nozzles 171 to 174. Preferably, the cool air injection nozzles are basically directed toward the door baskets 161 to 164. The door baskets 161 to 165 are vertically mounted on the door 150 at predetermined intervals.

When a specific storage space has a high level of cooling load due to storage of a high-temperature load (e.g. food), the temperature thereof detected by one of the temperature sensors 165 to 168 provided in the storage spaces is transferred to the controller. The controller recognizes the temperature variation of the specific storage space to operate the drive motors. The drive motors are driven to rotate the cool air injection nozzles 171 to 174 connected thereto so that the cool air is injected toward the specific storage space.

If a specific storage space is weakly cooled or stores a new load, the cool air injection nozzles 171 to 174 are controlled by the controller to be directed toward the specific storage space. For example, as shown in FIG. 8B, when the fourth or bottom door basket 164 is weakly cooled or stores the new load, the controller controls the rotational directions of the cool air injection nozzles to be directed forwardly and downwardly.

In this case, the degrees of rotation of the cool air injection nozzles are varied according to the positions of the cool air injection nozzles. In other words, the cool air injection nozzle 174 corresponding to the fourth door basket 164 is directed forward, and the cool air injection nozzles 171 to 173 corresponding to the first to third door baskets 161 to 163 are rotated forward and downward by an amount larger than the cool air injection nozzle 174 corresponding to the fourth door basket 164.

As set forth above, the cool air is compressed and is moved toward the auxiliary duct by the auxiliary fan provided in the damper so that the channel resistance of the cool air transferred toward the auxiliary duct decreases to strengthen the pressure of the cool air injected from the injection nozzles.

According to the preferred embodiment of the invention as set forth above, the newly stored load is recognized by the visual image devices mounted on the inside wall of the refrigerating chamber to discharge the cool air toward the load so that the newly stored load can be rapidly cooled to uniformly maintain the temperature distribution in the refrigerator and reduce the power consumption of the refrigerator by a large amount.

Therefore, according to the preferred embodiment of the invention, using the temperature sensor together with the weight of the object allows targeted, focused or directed cooling of the newly stored load thereby improving focused cooling performance with respect to the load.

Further, according to the another preferred embodiment of the invention, the cool air is targeted and discharged toward a specific storage space such as a door basket which is warmer than the surroundings by using the temperature sensors so that the temperature in the refrigerator can be uniformly maintained. This also promotes the commercial value of the refrigerator by allowing the user to visually confirm mechanical operation in targeted cooling thereby raising expectation for the performance of the refrigerator.

Although the invention as set forth above has been described about the side-by-side refrigerator as shown in the drawings, it is apparent that the invention can be applied to all types of cooling devices or refrigerators, such as a top freezer type, a refrigerator only type and a freezer only type, etc.

The present disclosure relates to subject matter contained in priority Korean Application Nos. 2002-0002823 filed on Jan. 17, 2002 and 2002-4884 filed on Jan. 28, 2002, which is herein expressly incorporated by references in its entirety.

What is claimed is:

1. An apparatus for controlling cool air in a cooling device comprising:

at least one visual image generating device that generates visual images of a load when an opening/closing operation of a cooling device door is performed;

a control device that controls a drive body to rotate in accordance with a relation between a first visual image taken before the load is stored and a second visual image taken after the load is stored; and at least one discharge device that discharges the cool air toward the load according to the control of the control device.

2. The apparatus for controlling cool air in a cooling device according to claim 1, further comprising a detection device that detects the opening/closing operation of the cooling device door to transfer a detection signal to the control device.

3. The apparatus for controlling cool air in a cooling device according to claim 1, wherein the first visual image, taken before the load is stored, is generated when the cooling device door is opened/closed.

4. The apparatus for controlling cool air in a cooling device according to claim 1, wherein the load is placed in a load storing space.

5. The apparatus for controlling cool air in a cooling device according to claim 1, wherein the relation is provided by a variation in at least one of a position and a size of the load in the load storing space.

6. The apparatus for controlling cool air in a cooling device according to claim 1, wherein the visual image generating device photographs the load storing space whenever the refrigerator door is closed.

7. The apparatus for controlling cool air in a cooling device according to claim 1, wherein the drive body has a circular shape, and the discharge device extends through the drive body.

8. The apparatus for controlling cool air in a cooling device according to claim 7, wherein the drive body is mounted on an inside wall of the cooling device and extends into a drive body housing having a circular inner shape.

9. The apparatus for controlling cool air in a cooling device according to claim 1, wherein a rotation of the drive body varies according to at least one of a position and size of the load storing space.

10. The apparatus for controlling cool air in a cooling device according to claim 1, wherein the visual image generating device is positioned above each of the drive bodies.

11. A method for controlling cool air in a cooling device, the method comprising:

generating visual images of a load whenever an opening/closing operation of a cooling device door is performed;

controlling a drive body to rotate according to a relationship between a first visual image taken before the load is stored and a second visual image taken after the load is stored; and discharging the cool air toward the load.

12. The method for controlling cool air in a cooling device according to claim 11, further detecting the opening/closing operation of the cooling device door, and generating the visual image in response to the detection.

13. The method for controlling cool air in a cooling device according to claim 11, wherein the first visual image is generated when the cooling device door is opened/closed.

14. The method for controlling cool air in a refrigerator according to claim 11, wherein the relationship is a variation of at least one of a position and a size of a load within a load storing space.

15. The method for controlling cool air in a cooling device according to claim 14, further comprising varying a rotation of the drive body according to at least one of the position and the size of the load in the load storing space.

16. A method for controlling cool air in a cooling device, the method comprising:

transferring an operating command to a visual image generating device in accordance with an opening/closing operation of a cooling device door;

transferring a visual image generated by the visual image generating device of a load storing space to a control device in response to the operating command; and controlling a drive body to rotate in accordance with a variation in the visual image, to discharge the cool air.

17. The method for controlling cool air in a cooling device according to claim 16, further comprising generating the operating command based upon detecting an opening/closing operation of the cooling device door.

18. The method for controlling cool air in a cooling device according to claim 16, wherein the variation of the visual image is determined according to the presence of the load in a load storing space.

19. The method for controlling cool air in a cooling device according to claim 18, wherein at least one of the position and size of the load are recognized from the visual image when the load is present in the load storing space.

* * * * *